United States Patent [19]

Adamson et al.

[11] Patent Number: 4,693,460

[45] Date of Patent: Sep. 15, 1987

[54] AUTOMATIC GARMENT PORTION LOADER

[75] Inventors: Fletcher D. Adamson; James M. Caldwell, both of Alexander City, Ala.

[73] Assignee: Russell Corporation, Alexander City, Ala.

[21] Appl. No.: 861,826

[22] Filed: May 12, 1986

Related U.S. Application Data

[62] Division of Ser. No. 803,416, Dec. 2, 1985, Pat. No. 4,633,604.

[51] Int. Cl.[4] ..... B65H 5/00

[52] U.S. Cl. ..... 271/10; 271/13; 271/227; 271/248; 271/251; 112/121.15; 112/304; 112/306; 112/272; 198/394; 198/395; 209/539; 209/552

[58] Field of Search ..... 112/153+, 112/306, 121.29, 121.15, 304+, 272, 121.12; 271/226, 227, 248–253, 261, 176, 10, 13, 17, 15, 228, 254; 209/539, 552, 576, 577; 198/394, 395

[56] References Cited

U.S. PATENT DOCUMENTS

| | | | |
|---|---|---|---|
| 3,232,256 | 2/1966 | Buckalter | 112/304 X |
| 3,232,429 | 2/1966 | Norwich | 209/539 X |
| 3,589,320 | 6/1971 | Beazley | 112/304 X |
| 3,598,070 | 3/1971 | Rosenberg | 271/227 X |
| 4,111,412 | 9/1978 | Cathers | 271/251 |
| 4,270,879 | 6/1981 | Kacirek | 271/176 X |
| 4,410,171 | 10/1983 | Kobayashi | 271/227 |
| 4,426,073 | 1/1984 | Mizuma | 271/251 |
| 4,433,909 | 2/1984 | Goes In Center et al. | 271/227 X |
| 4,519,700 | 5/1985 | Barker et al. | 271/226 X |

FOREIGN PATENT DOCUMENTS

| | | | |
|---|---|---|---|
| 3412864 | 10/1984 | Fed. Rep. of Germany | 271/263 |

*Primary Examiner*—Joseph J. Rolla
*Assistant Examiner*—David H. Bollinger
*Attorney, Agent, or Firm*—Jennings, Carter, Thompson & Veal

[57] ABSTRACT

A garment portion loader utilizes a plurality of photoelectric sensors to determine the positions of garment portions at selected stations including a delivery assembly which supplies garment portions for loading, a pick-up assembly which removes garment portions from the delivery assembly and places them on an alignment conveyor, and an alignment assembly which aligns the garment portions with a pre-established standard relative to the alignment conveyor. A rejection assembly is provided to remove garments which are not properly aligned. The loader may be controlled by a microprocessor receiving input from the sensors and controlling the various assemblies.

5 Claims, 6 Drawing Figures

AUTOMATIC GARMENT PORTION LOADER

This is a division of application Ser. No. 803,416, now U.S. Pat. No. 4,633,604, filed Dec. 2, 1985.

FIELD OF THE INVENTION

The present invention relates to the field of textiles and more particularly to the field of manufacturing of garments from textiles. In even greater particularity the present invention may be described as an automated loading device for placing individual garments on an assembly line type conveyor whereon the garment portions are aligned and positioned with respect to a predetermined standard in order to facilitate hemming the garment portion.

BACKGROUND OF THE INVENTION

In the garment producing industry efforts have been made to reduce the amount of time consumed in producing garments and the amount of labor required to produce each individual garment. To this end automated sewing devices have been produced which enable the production line to stitch hems and seams of garments in an assembly line like fashion. That is to say, when the garment portion is placed on an assembly line in accordance with a predetermined standard the automated sewing machine can be directed to stitch along an edge of the garment in order to form a hem. In this manner the skills required for producing the garments have been reduced in that the machine operators no longer are required to simultaneously align the garment portion with the machine and hem the garment portion with the machine, but rather need only to be able to align the garment portion with the predetermined standard associated with the continuously moving garment portion conveyor. The automated sewing machine then performs the task of sewing along the edge of the garment portion. Of course, the operator must still place the garment portions on the conveyor and must align the garment portions with the standard in order to enable the automated sewing machine to provide the hem at the proper position along the edge of the garment. It is readily seen that the function of an operator in such an automated system would be a monotonus and tedious exercise.

SUMMARY OF THE INVENTION

It is the object of the present invention to provide an automated system which will place and align garment portions on a production line, such as a conveyor belt, without the necessity of an operator acting as the loader and aligner of the garment portions on the conveyor.

Another object of the invention is to provide a garment portion loader which operates at a steady and continual pace.

Yet another object of the invention is to provide an automated loader and aligner which can detect and remove misaligned garment portions before they reach the automated sewing machine.

Our invention utilizes a delivery system which may be of any convenient configuration such as a table whereupon a plurality of garment portions are arranged in prefolded stacks which can be raised to a predetermined level through the action of a subjacent lift device. A traveling pick-up assembly which moves in both a vertical and horizontal direction lifts the uppermost garment portion from the stack by one end of the garment portion and carries it along a line parallel to an alignment conveyor until the garment portion is draped over the alignment conveyor and a vacuum box adjacent the end of the alignment conveyor. The vacuum box removes wrinkles and folds from the garment. The pick-up assembly releases the garment onto the conveyor where a smoothing flow of air is directed onto the upper surface of the garment to remove any folds which may have been created at the release of the garment portion by the pick-up assembly. As the garment portion moves downstream on the conveyor an alignment device responsive to the presence of the garment portion on the conveyor utilizes a plurality of photoelectric cells to align one edge of the garment portion along a prepositioned alignment standard. Each photoelectric cell is a control mechanism for one of a plurality of alignment members which are used to move the garment transversely of the alignment conveyor toward the alignment standard. If the edge of the garment is not aligned with the standard within a predetermined time the garment is allowed to continue on the garment conveyor until it reaches a rejection apparatus which will remove the misaligned garment from the production line into a hopper so that the garment may be recycled. If the edge of the garment is aligned properly along the standard at the end of the predetermined time, then the garment is allowed to pass the rejection apparatus and is introduced to the production line.

BRIEF DESCRIPTION OF THE DRAWINGS

Apparatus embodying the features of our invention are depicted in the accompanying drawings which form a portion of the application and wherein.

DESCRIPTION OF A PREFERRED EMBODIMENT

Figure 1:
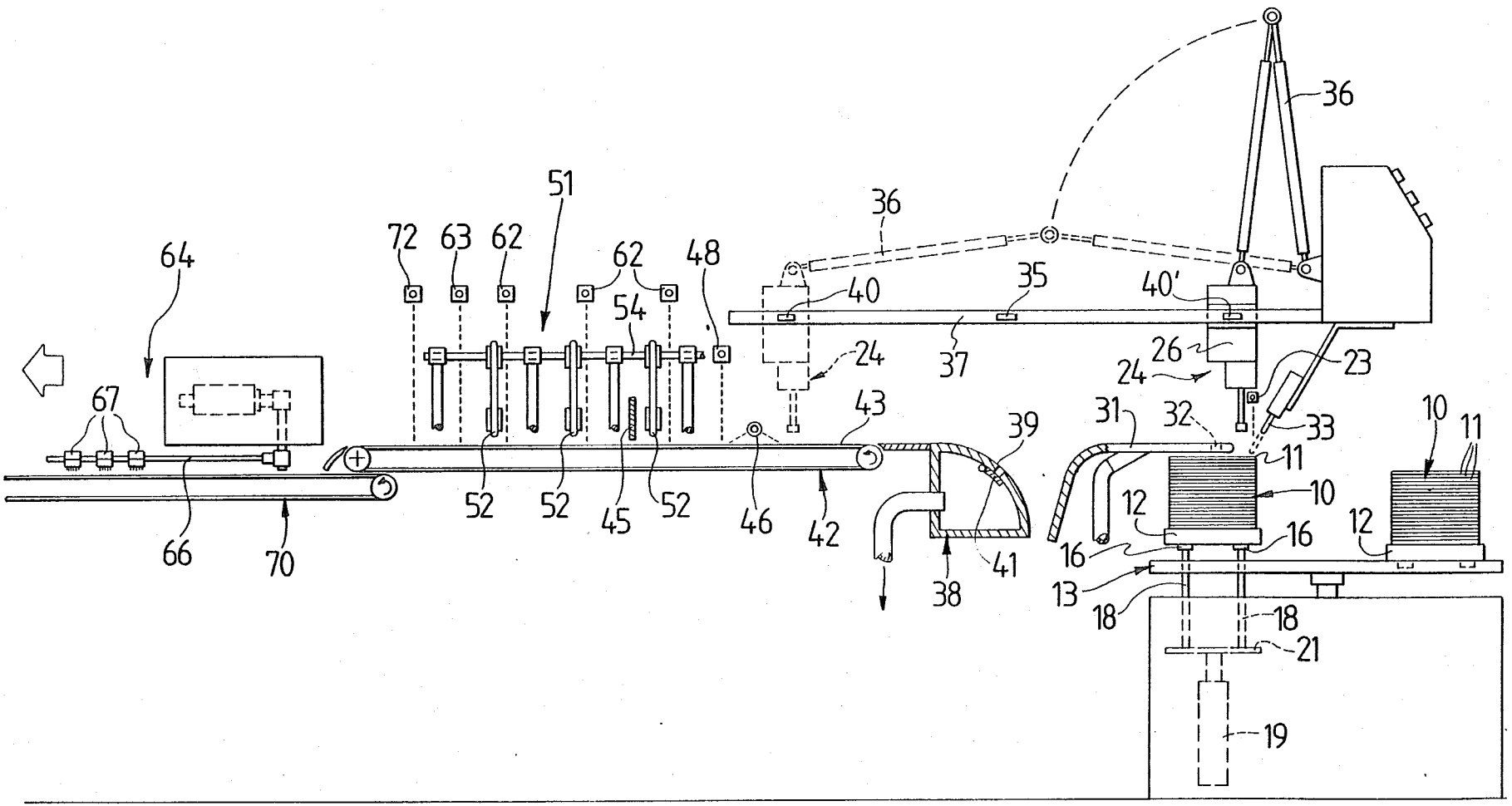
FIG. 1 is a diagrammatic side elevational view of our apparatus.
Figure 2:
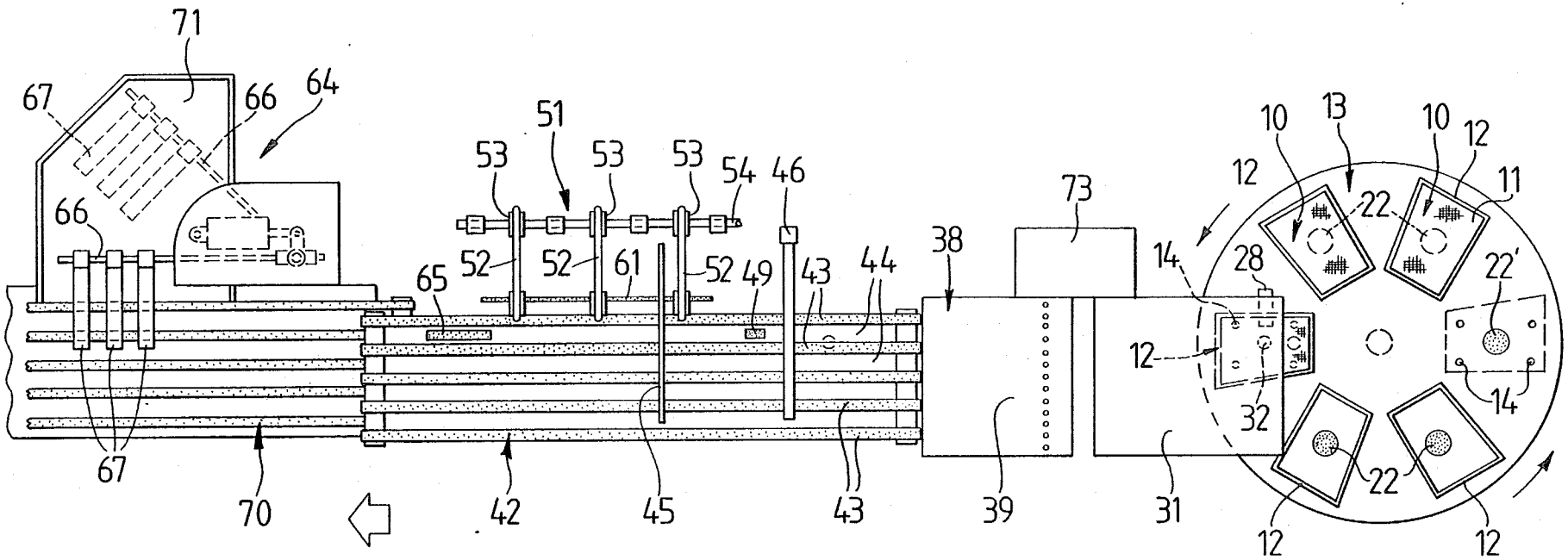
FIG. 2 is a diagrammatic plan view of the apparatus.
Figure 3:
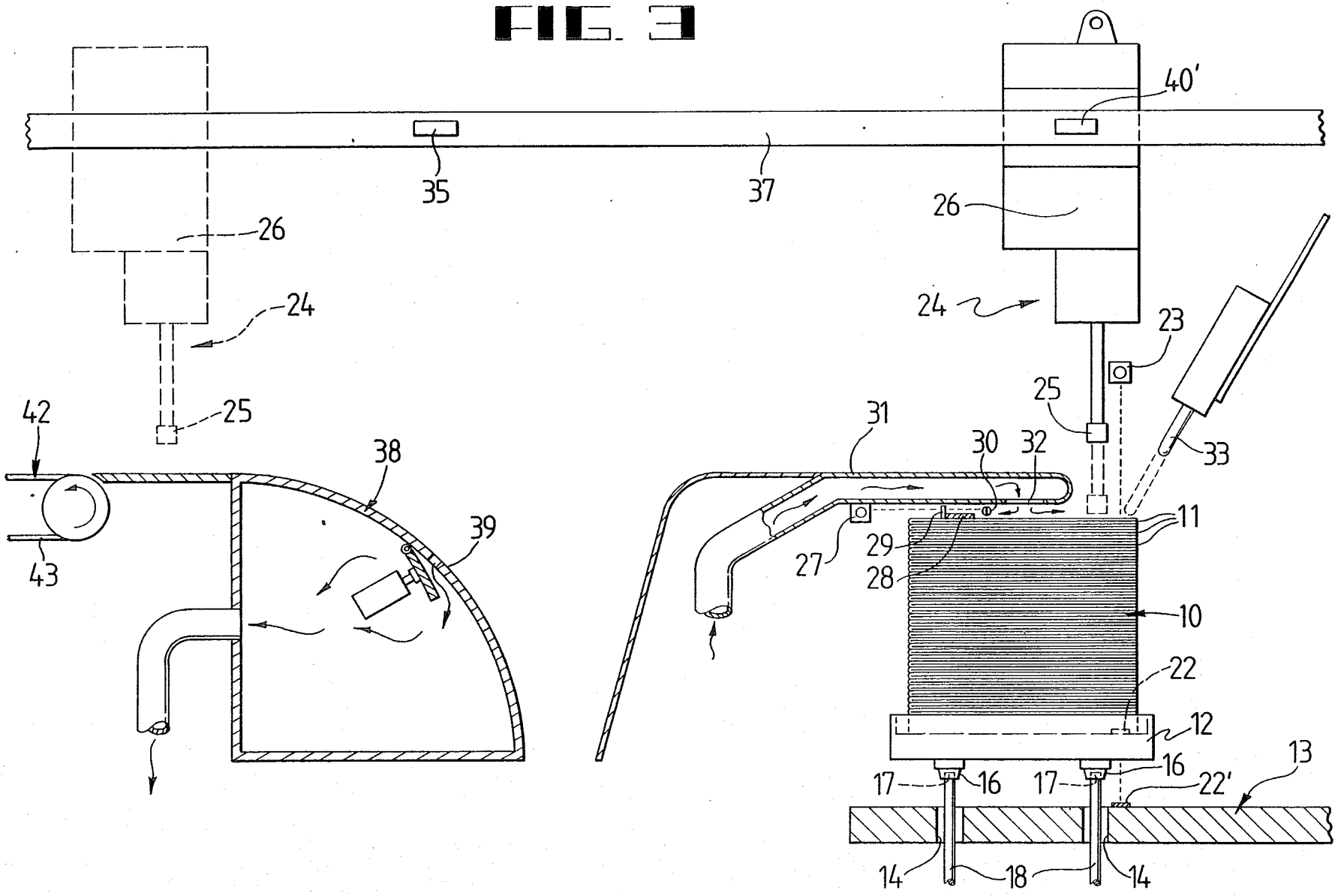
FIG. 3 is a detail view of the delivery mechanism with the delivery table and other parts shown partially in section.

Referring to FIG. 1, it may be seen that a stack 10 of garment portions 11, such as sleeves, are positioned on a tray 12 which is in turn placed on a delivery apparatus 13, such as a turntable or other conveyor. The delivery apparatus 13 has a plurality of positions thereon at which each platen or tray 12 may be positioned. Each of these positions is defined by a plurality of vertical passageways 14, as seen in FIG. 2, extending upwardly through the delivery apparatus 13. Each tray 12 has a set of cooperatively positioned feet 16, as shown in FIG. 3, which have downwardly opening recesses 17 formed therein. A set of rods 18 extend upwardly through the passageways 14 and engage the recesses 17 in the feet 16 of the tray 12 while each tray 12 is in a position for the garment portions 11 to be removed therefrom. The rods 18 are simultaneously moved in the vertical direction by a vertical actuator 19 such as a worm unit which is attached to a plate 21 and which connects each of the rods one to another to assure that the rods 18 move as a unit. Each tray 12 has positioned in a predetermined area thereon a reflective surface 22 such as a piece of retro-reflective tape of an area painted with retro-reflective paint. When each tray 12 is properly aligned and positioned on the delivery apparatus 13 for the garment portions 11 to be removed therefrom, this reflective surface 22 is positioned beneath a photo-electric sensor 23 which may be any of a variety of infrared photo-electric sensors which have an infrared generating means and sensing means positioned such that light from the generating means is reflected by the reflective surface 22 and detected by the sensors 23 when there are no garment portions 11 on the tray 12. The photo-electric sensor 23 will detect a no garment portion condition and the delivery apparatus will be directed to position another tray 12 beneath the photo-electric sensor 23.

The photo-electric sensor 23 is positioned proximal to a pick-up assembly 24 which may be a plurality of grippers 25 designed to be raised and lowered by a pneumatic cylinder 26. To facilitate the removal of the garment portions from the stack the grippers 25 are set to grip the fabric at a predetermined height; therefore the subjacent stack 10 must be incrementally raised by the vertical actuator 19 each time a garment portion 11 is removed from the stack 10. To accomplish this we use a photo-electric sensor or up-eye 27 mounted at the desired height in conjunction with a flexible metallic finger 28 which carries thereon an upturned vane 29 and which is moved upwardly by the press of garment portions 11 therebeneath such that the vane 29 blocks an infrared beam directed to the up-eye 27 from a light source 30. When the vane 29 interrupts the infrared light being directed at the up-eye 27, the actuator 19 ceases and the uppermost garment portion 11 is at the proper height for removal by the pick-up assembly 24.

To assist in the proper removal of each garment portion 11 from the top of the stack 10, a hollow metallic plate 31 is provided which extends across the top of the stack 12 to a point proximal the downwardmost point of travel of the pick-up assembly 24. The hollow plate 31 has a downwardly opening aperture 32 positioned above the center of the uppermost garment portion 11 through which forced air at a low pressure is directed onto the upper surface of the subjacent garment portion 11. This high volume of low pressure air directed onto the upper surface of the garment portion 11 creates an airfoil type effect which causes the upper layer of fabric of each folded garment portion 11 to lift and separate from the subjacent layer of fabric. When the uppermost layer of fabric is thus suspended it facilitates the ability of the grippers 25 to grasp this single layer of fabric. There is also provided in conjunction with the pick-up assembly 24 a pneumatically operated hold finger 33 which reciprocates to and from a position atop the uppermost layer of fabric of the stack 10 and applies a gentle pressure to the top layer of fabric.

The pick-up assembly 24 is moved in the horizontal direction by means of a pneumatic actuator 36, such as an Origa band-type penumatic cylinder or other suitable pneumatic actuator. The pick-up assembly 24 is supported along its horizontal travel by a track 37 which extends above the hollow plate 31.

The hollow plate 31 curves downwardly and forwardly from the top of the stack 10 and beneath the track 37. Adjacent the downwardly curved portion of the hollow plate 31 is a vacuum box 38 which has an arcuate perforated surface 39. As shown in FIG. 1, a movable closure member 41 allows the interior of vacuum box 38 to be maintained at a subatmospheric pressure while controlling the flow of air through the perforated surface 39. The perforated surface 39 and the downwardly curved portion of plate 31 face each other, forming a trough.

Adjacent the vacuum box 38 on the opposite side thereof from the plate 31 is an alignment conveyor 42. This alignment conveyor 42 has a plurality of parallel endless belts 43 interspaced across a horizontal support 44. The belts 43 carry the garment portion 11 along the conveyor 42. The track 37 extends above the conveyor 42 to allow the pick-up assembly 24 to carry the garment portions 11 partially onto the conveyor 42.

An air wand 46 is mounted transversely above the conveyor 42 and slightly downstream from the end of the track 37. The air wand 46 directs air onto and along the surface of the conveyor 42 in response to the output of a photo-electric sensor or squirt eye 48 mounted proximal the air wand 46. The squirt eye 48 senses an IR light beam reflected from a reflector 49, such as a retro-reflective tape, placed on the support 44 proximal the air wand 46. Garment portions 11 carried by the belts 43 interrupt the light path as they cover the reflector 49, thus actuating the air wand 46.

Figure 4:
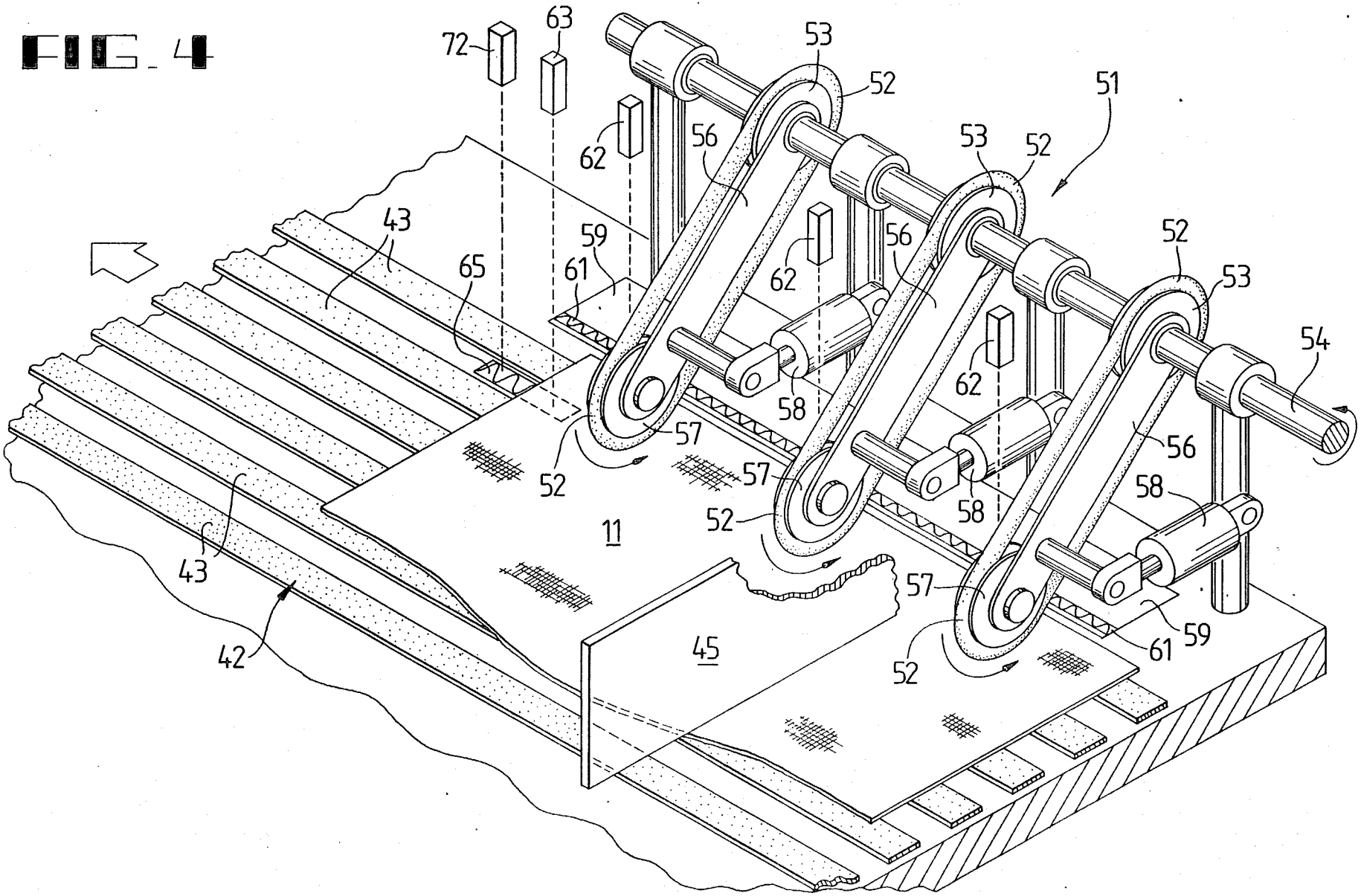
FIG. 4 is a perpsective view of the alignment means.
Figure 5:
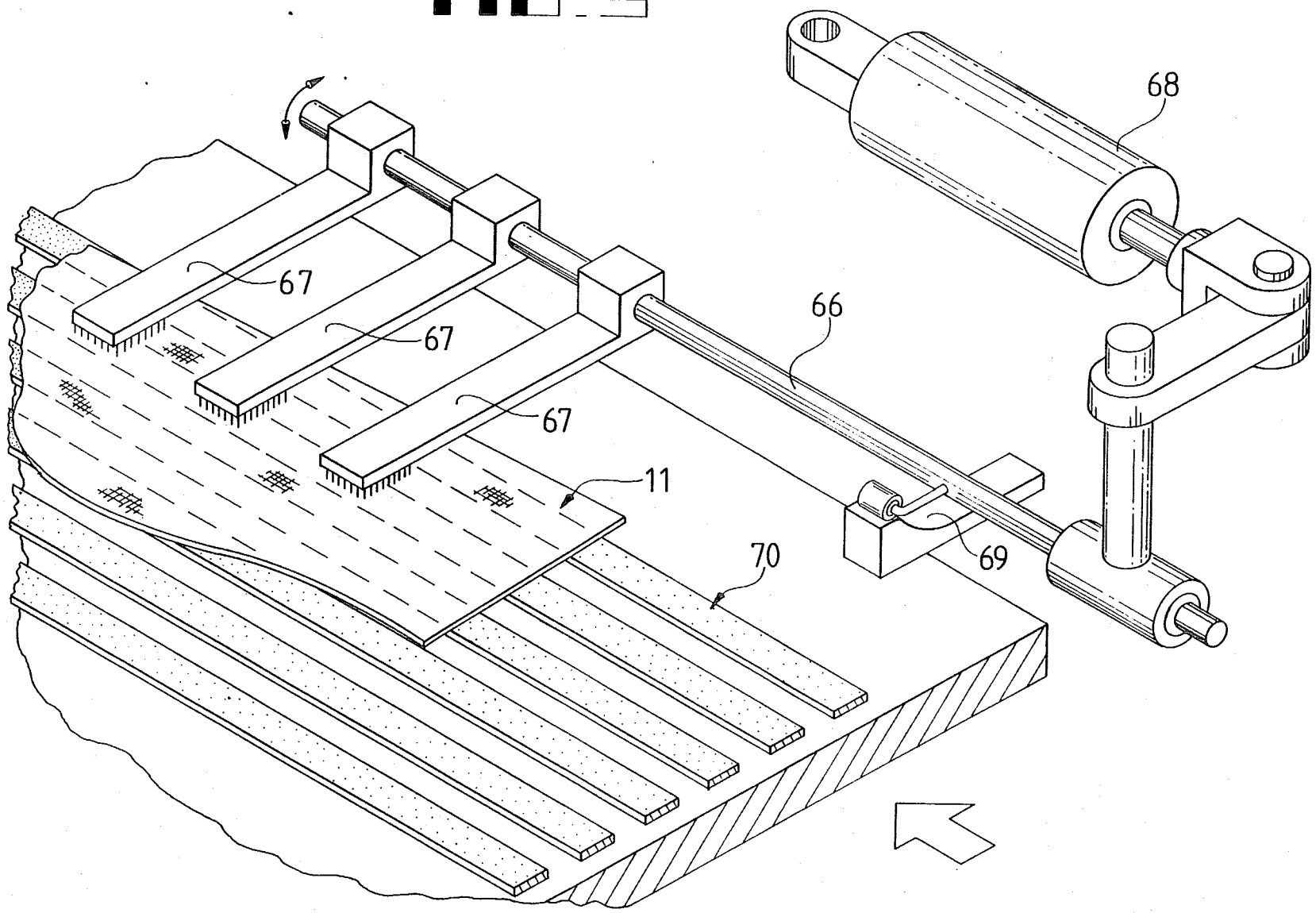
FIG. 5 is a detail perspective view of the rejection apparatus.

Downstream of the air wand 46 is an alignment assembly 51. This alignment assembly 51 utilizes a plurality of alignment belts 52 which are mounted transversely of the conveyor 42 and are driven by individual drive pulleys 53 carried on a common shaft 54. The shaft 54 has its longitudinal axis aligned parallel to the conveyor 42 and is mounted outwardly of the conveyor belts 43, as shown in FIG. 4. Each alignment belt 52 has associated therewith a frame 56 which carries thereon a secondary sheave 57 around which the belt 52 travels. Each frame 56 is pivotally mounted for movement about the shaft 54 and has associated therewith a pneumatic actuator 58 which positions the frame 56 and thus its belt 52 selectively adjacent the upper surface of the conveyor 52 or spaced from the upper surface of the conveyor 42. The shaft 54 is driven by suitable means, not shown.

Adjacent an edge of the conveyor 42 is an adjustable shelf 59 on which a strip 61 of reflective material, such as a retro-reflective tape, is placed. This strip 61 may run parallel to the conveyor 42 and serves as an alignment standard which may be moved relative to the adjacent edge of the conveyor 42. The shelf 59 provides a substantially continuous surface outwardly of the conveyor 42 to support the garment portion 11, adjacent the standard. Each alignment belt 52 has associated with it an alignment eye 62 which is a photoelectric sensor as discussed hereinabove mounted above the strip 61. Each alignment eye 62 serves as a control for the associated pneumatic actuator 58 to raise the frame 56 when the light path from strip 61 to the photo sensor is obscured by the edge of a garment portion 11.

Downstream of the belts 52 is a key eye 63 which is a photo-electric sensor positioned above a reflective surface 65 formed on the support 44. This key eye 63 senses the leading edge of a garment portion 11, then causes the conveyor belts 43 to temporarily stop and the alignment belts 52 to be lowered to contact the garment portion 11 to urge it laterally and align the lateral edge of the garment portion 11 with the strip 59.

In addition to serving as control devices for the pneumatic cylinder 58, each alignment eye 62 serves as an input to control a rejection assembly 64 which is located downstream of the alignment assembly. The rejection assembly 64 utilizes a sweep arm 66 which is mounted for pivotal movement about a vertical axis. The sweep arm 66 carries a plurality of adhering members such as carding cloths 67, which serve to engage garment portions 11 which are to be rejected. The carding cloths 67 are located at a height above a transfer conveyor 70 sufficient to prevent engagement of properly aligned garment portions 11. If any one of the alignment eyes 62 fails to register proper alignment of the garment portions 11, then the rejection assembly is activated. The sweep arm 66 is driven through an arc by a conventional pneumatic actuator 68. As the sweep arm 66 begins this arc a supporting cam surface 69 allows the arm 66 to descend so that the carding cloths 67 are lowered to engage the garment portion 11. At the end of the arc the carding cloths 67 are positioned outwardly of the conveyor over a hopper 71 into which the garment portion 11 drops by its own weight.

A control eye 72 of the photo-electric type hereinabove described may be positioned along the conveyor 42 or 70 to indicate to downstream processing devices that the garment portion 11 is being passed to such devices for such processing.

Figure 6:
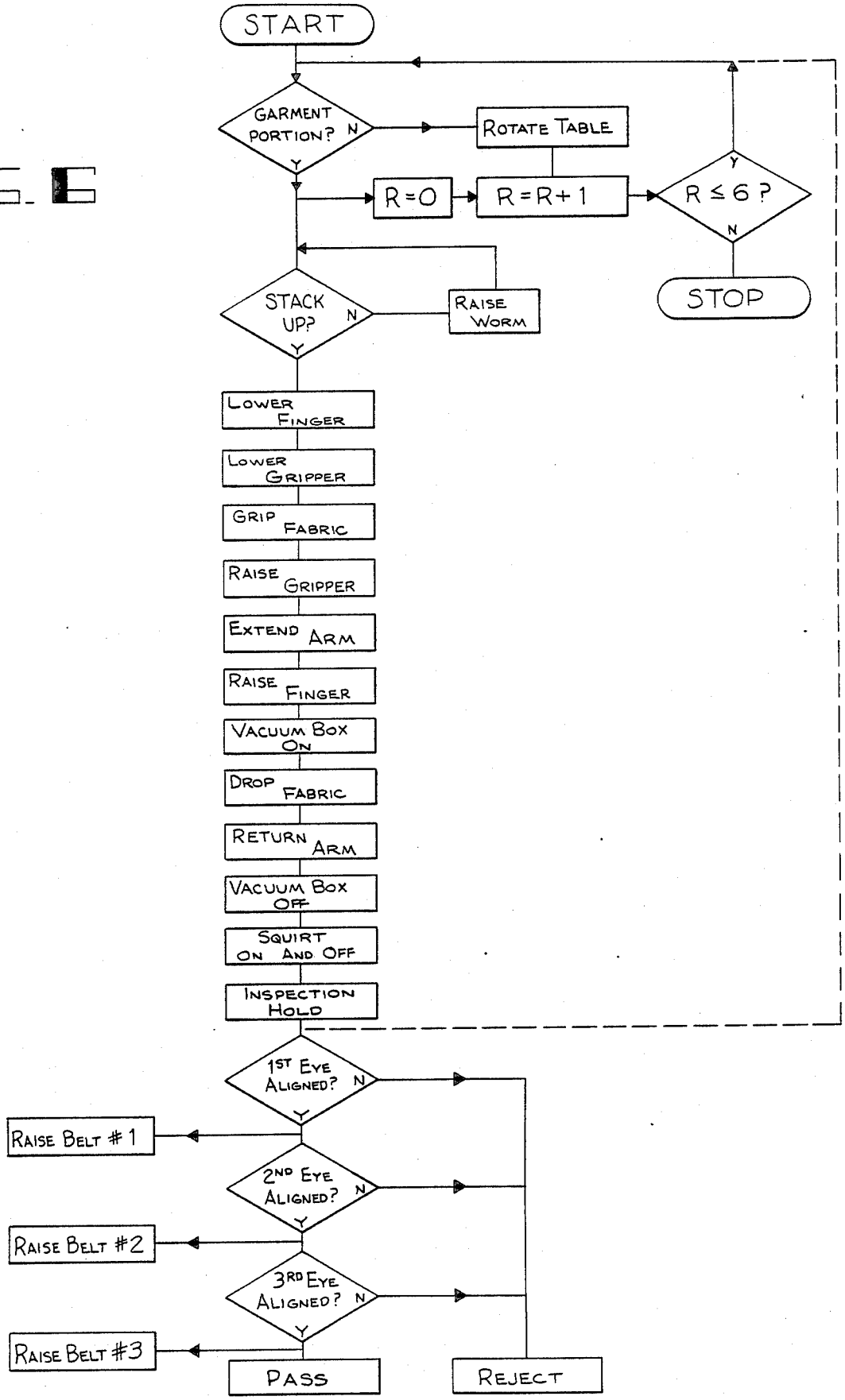
FIG. 6 is a flow chart representation of the operation of the apparatus.

It will be appreciated that the input from the various sensors can be advantageously sorted and coordinated through the use of a microprocessor, shown generally at 73, such as a GE Series 1 processor. The microprocessor 73 serves to control each device as will be understood with references to the flow chart shown in FIG. 6 and the following description of the operation of the apparatus. When the apparatus is started and continuously thereafter microprocessor 73 is provided with the output of photo-electric sensor 23 which indicates whether a garment portion 11 is present on the tray 12 which is positioned beneath the pick-up assembly 24. It should be noted that if this tray 12 is missing, a secondary reflective surface 22' is exposed on the delivery apparatus 13 thereby giving the same result as if the tray 12 were in position. If no garment portion 11 is present the processor 73 directs the delivery apparatus 13 to move to the next tray position. Of course the rods 18 must be retracted for this step. This procedure is repeated until a tray 12 carrying garment portions 11 is positioned beneath the pick-up assembly 24 or until all the tray positons (six positions in the exemplary flow chart) have been sampled. If no garment portions 11 are available the apparatus is shut off. If one or more garment portions 11 are sensed by the sensor 23, then the up-eye 27 must indicate to the microprocessor 73 whether the stack 10 is at the proper level. If the stack is too low, the processor 73 will direct the vertical actuator 19 to raise the rods 18 until the stack 10 on this tray 12 presses against the finger 28 and causes the vane 29 to interrupt the optical path to the eye 27 at which time the uppermost layer of fabric of the top garment portion 11 will be at the proper height. During this activity and continuously while the apparatus is on, a high volume, low pressure air stream is directed out of aperture 32. As this air stream spreads over the surface of the top garment portion 11 it lifts the fabric of the garment portion as hereinabove described. When the stack 10 is properly positioned, the hold finger 33 descends and applies pressure to the edge of the stack 10 while the pick-up assembly 24 descends and grips the top layer of fabric near an edge thereof and intermediate the hollow plate 31 and the hold finger 33. The pick-up assembly 24 carrying the garment portion 11 is moved vertically by the actuator 26 and horizontally by the arm 36, thereby pulling the garment portion 11 from beneath the plate 31 and hold finger 33 and across the top of the plate 31. The hold finger 33 is then retracted.

As the pick-up assembly 24 moves horizontally it actuates a magnetic sensor 35 which opens the closure member 41 on vacuum box 38, allowing the vacuum box 38 to draw air through the perforated surface 39. Inasmuch as the garment portion 11 is gripped only at one end thereof, the opposite or free end is draped over the vacuum box 38 as the pick-up 24 moves forwardly. Thus, the free end of the garment portion 11 is subjected to a slight resistance due to the air flow through the perforated surface 39. This slight resistance has a smoothing effect on the material and thus reduces the tendency of the garment portion 11 to fold or gather on itself.

When the pick-up assembly 24 reaches its end of travel a magnetic sensor 40 sends a signal to the processor 73 which directs the pick-up assembly 24 to release the garment portion 11 onto the conveyor 42. The pick-up assembly 24 returns to its "home" position, as may be sensed by a magnetic sensor 40' and the closure member 41 closes the perforated surface 39. As the pick-up assembly 24 returns to its home position the belts 43 draw the garment portion further onto the conveyor fromthe vacuum box 38. Inasmuch as folds in the material may have occurred when the garment portion 11 was released by the pick-up assembly 24, the squirt eye 48 signals the processor 73 when the leading edge of the garment portion 11 has passed under the air wand 46. The air wand 46 is then directed to deliver a short burst of air along the surface of the garment portion 11 to remove any folds. A downstream baffle 45 is provided to prevent the air burst from impinging on a downstream garment portion.

The garment portion 11 passes beneath the alignment belts 52 until the leading edge of the garment portion 11 is sensed by the key eye 63. The processor 73 then stops the conveyor 42 for a predetermined hold interval and lowers the alignment belts 52 which are driven continuously by the shaft 54. The alignment belts 52 each engage the garment portion 11 and urge it laterally on the conveyor 42 to align the edge of the garment portion over the strip 61. When the edge is sensed by the associated alignment eye 62 the microprocessor 73 directs the pneumatic actuator 58 to lift the frame 56 and thus removes the belt 52 from engagement with the garment portion 11. If all of the alignment belts 52 are raised during the interval, the microprocessor 73 determines the garment portion 11 to be properly aligned and passes the garment portion 11 for further processing downstream in the production line.

If any alignment belt 52 has not been raised at the end of the hold interval, the processor 73 determines that the garment portion 11 is not properly aligned and initiates a rejection sequence. The conveyor 42 delivers the garment to the transfer conveyor 70 beneath the carding cloths 67 at a predetermined time after the hold interval has ended. As the garment portion 11, not properly aligned, passes beneath the rejection assembly 64 it is engaged and removed from the conveyor 70. While the rejection assembly 64 shown utilizes a plurality of carding cloths 67 mounted on a pivoting sweep arm 66 that follows a cam surface 69 to engage the garment portion 11, clearly a number of alternative rejection assemblies may be used.

The above description of the operation of the apparatus follows a single garment portion 11 through the flow of the apparatus. It is to be understood that the various assemblies may be functioning simultaneously such that one garment portion may be aligned while another is positioned by the pick-up assembly 24 so that a continuous operation of the apparatus may be facilitated as indicated by the dashed return line in FIG. 6.

While we have shown our invention in but one form, it will be obvious to those skilled in the art that it is not so limited, but is susceptible of various changes and modifications without departing from the spirit thereof.

The embodiments of the invention in which an exclusive property or privilege is claimed are defined as follows:

1. Apparatus for loading fabric garment portions onto an automated production line wherein each of said garment portions are moved along a plurality of tandem conveyors and each said garment portion is required to have one edge thereof aligned at a predetermined line relative to said plurality of conveyors, comprising:

(a) means for placing individual garment portions on one of said plurality of conveyors at a predetermined position and in a substantially foldless manner;

(b) means responsive to the position of said one edge of said garment portion relative to said predetermined line for urging said garment portion toward said predetermined line with said means for urging being operable only during a specified time; and (c) means responsive to the position of said one edge of said garment portion relative to said predetermined line at the end of said interval of time for removing misaligned garment portions from the production line.

2. Apparatus as defined in claim 1 wherein said means for placing comprises:

(a) a delivery assembly having a plurality of garment portions supporting positions; and (b) a pick-up assembly for transferring garment portions from said delivery assembly to said conveyor including means for sensing the presence of garment portions at a supporting position proximal said pick-up assembly.

3. Apparatus as defined in claim 1 wherein said means for urging comprises:

(a) a plurality of alignment belts mounted substantially transversely of said conveyor and movable individually and selectively to an elevated non-garment portion engaging position and to a lowered garment engaging position;

(b) means for sensing the presence of said garment beneath said plurality of belts operatively connected to said plurality of belts for initiating the lowering of said plurality of belts; and (c) means for sensing the position of the edge of said garment portion relative to said predetermined line and operatively connected to said plurality of belts to initiate individually raising each belt of said plurality of belts to said elevated position as the edge of said garment portion proximal each of said belts is aligned with said line.

4. An automated loading apparatus for loading garment portions onto a production line utilizing a microprocessor control unit comprising:

(a) means for placing individual garment portions on said production line in a substantially foldless manner in accordance with signals from said control unit including means for signaling to said control unit whether said garment portions are available;

(b) means responsive to said control unit for aligning an edge of said garment portions on said production line with a predetermined standard with said means for aligning operable only during a specified time and including means for sensing the position of said edge relative to said standard having an output to said control unit; and (c) means responsive to said control unit at the end of said specified time for removing garment portions from said production line.

5. Apparatus as defined in claim 4 wherein said means for aligning comprises:

(a) a plurality of photo-electric sensors positioned above said standard and adapted to sense the edge of each garment portion at said standard, with each sensor having an output to said control unit;

(b) a plurality of members adapted to individually urge each garment portion toward said standard under the control of said control unit and in accordance with the output of each photo-electric sensor; and (c) a photo-electric eye responsive to the presence of a garment portion beneath said means for aligning having an output to said control unit.

* * * * *